United States Patent [19]

Thurnau et al.

[11] Patent Number: 4,557,098

[45] Date of Patent: Dec. 10, 1985

[54] DEFORMABLE CENTERING SLEEVE FOR TAB OF ROOF PANEL ATTACHMENT CLIP UNIT

[75] Inventors: Vernon L. Thurnau, Kansas City; Arturo Mariano, Independence, both of Mo.

[73] Assignee: Butler Manufacturing Company, Kansas City, Mo.

[21] Appl. No.: 585,161

[22] Filed: Mar. 1, 1984

[51] Int. Cl.[4] ..... E04B 1/56

[52] U.S. Cl. ..... 52/712; 52/467; 52/573

[58] Field of Search ..... 403/112; 52/712–715, 52/716–718, 463, 467, 173, 573; 24/545, 546, 530, 531, 67.9, 563

[56] References Cited

U.S. PATENT DOCUMENTS

| | | | |
|---|---|---|---|
| 1,236,654 | 8/1917 | Baltzley | 24/564 |
| 1,429,182 | 9/1922 | Ashley | 24/563 |
| 1,805,425 | 5/1931 | Stocks | 24/563 |
| 3,021,581 | 2/1962 | Cook et al. | 24/561 |
| 3,376,680 | 4/1968 | Gyekis | 52/467 |
| 3,512,227 | 5/1970 | Krawagna | 248/113 |
| 4,332,060 | 6/1962 | Sato | 24/67.9 |

FOREIGN PATENT DOCUMENTS

| | | | |
|---|---|---|---|
| 573405 | 3/1924 | France | 24/561 |

*Primary Examiner*—James L. Ridgill, Jr.

*Attorney, Agent, or Firm*—Shoemaker and Mattare, Ltd.

[57] ABSTRACT

A deformable sleeve for centering a roof panel mounting tab on a roof panel attachment clip unit prior to installation of the clip unit and the roof panels on a building. The centering sleeve has an elongated body with two sides, one edge of each side being connected together by hinge structure, and the opposite edge of each side having a mounting facilitating flange extending therealong. In order to increase the deformability of the sleeve, cutouts are provided in at least one edge of each side, and preferably in both edges of each side. These cutouts may be of various shapes including semi-elliptical, V-shaped, rectangular shaped, or square shaped. A modification of the mounting facilitating flange includes a thickened portion extending along the non-hinged edge of each sleeve side to facilitate the mounting of the sleeve on a support piece of the roof panel attachment clip unit.

A further embodiment employs an area of reduced thickness in the mid-portion of each sleeve side together with tapered sleeve ends for increasing the deformability of the sleeve and for decreasing the force needed to deform the sleeve.

57 Claims, 25 Drawing Figures

DEFORMABLE CENTERING SLEEVE FOR TAB OF ROOF PANEL ATTACHMENT CLIP UNIT

BACKGROUND OF THE INVENTION

The present invention relates, in general, to building roofs, and, more particularly, to means for attaching roof panels to building structural members.

Butler Manufacturing Company markets roofs for buildings under the trademarks MR-24 and CMR-24. These roofs include a multiplicity of panels which are seamed together and attached to the building structural elements in a manner which permits movement of those panels to accommodate thermal expansion and contraction.

There are clip units for attaching these panels to the building structural elements such as the roof purlins or the like.

Even though effective, these known clip units have several disadvantages. For example, in a prior clip unit patent application assigned to the same assignee as the present invention, centering structure is provided for holding the roof panel attaching tab centered during initial installation of roof panels on a building. However, once the installation has been completed, it is highly desirable that the tab be permitted to move due to thermal contraction and expansion of the roof panels in use. In the prior application, breakable or fracturable centering structures have been disclosed. However, it has been discovered that even this structure can be improved upon.

SUMMARY OF THE INVENTION

The clip unit embodying the present invention includes a one-piece base attached to a building structural element, a cross-piece attached to the base, and a one-piece slidably mounted on the cross-piece. Snap-on, deformable sleeves are mounted on the cross-piece to maintain the tab in the desired center position on that cross-piece.

The tab is generally attached to the base by looping that tab around the cross-piece and the cross-piece, being smooth and either oblong or triangular, provides an excellent sliding surface for the looped tab. The cross-piece is located adjacent to the upper portion of the clip base near the panels, thereby providing maximum slidability for the tab. A positive, factory applied centering structure for the tab for use during the initial installation of the clip unit is located on the cross-piece and thus the tab will not be dislodged during normal shipping or handling.

The clip unit provides full panel retention and support yet has minimum contact between the panel and the clip for reduced heat transfer. The top of the clip unit base has aprons which provide full panel support and include rounded corners.

A preferred embodiment of the centering structure includes snap-on deformable sleeves. The important concept is that the centering structure will hold the tab centered and in proper position during initial installation of the panels over the clip unit, but will deform under moderate loads to permit shifting of the panel locked tab thereafter under thermal stresses, contraction and expansion of the combined elements.

While the centering sleeves are primarily constructed to be deformable, it is also recognized that in some cases the sleeve will actually crack and break into several pieces, depending on how much roof expansion occurs.

It is desired that the sleeves will move, deform or even break up with a minimum amount of longitudinal pressure, that is, pressure in the range of 3 to 5 lbs.

The tab is an effective, efficient design having a one-piece unitary body looped around the cross-piece and having both ends of the tab fixed in the folded seam connecting two adjacent roof panels. The tab has a cross-over configuration which eliminates a need for a double thickness element in the roof seam.

The base and cross-piece of the clip unit provide full panel support and modularity of installation. The cross-piece is preferably triangular, but can also be oblong in shape. The preferred triangular shape keeps the tab properly oriented and permits easy slidability thereof. The pair of deformable centering sleeves on each side of the tab keep it centered during initial roof panel installation, and yet after being installed and seamed into the roof panel, permit tab movement due to thermal stresses when necessary.

OBJECTS OF THE INVENTION

It is a main object of the present invention to provide a device for attaching roof panels to a building structural element in a manner which maintains tab attaching structure in proper centered orientation during initial panel installation, and yet permits tab movement later due to thermal expansion and contraction of the roof panels.

It is another object of the present invention to provide structure for attaching roof panels to building roof purlins in a manner which facilitates slidability of a centered tab connecting the panels to a base of a clip unit so that thermal expansion of the panels relative to the supporting roof purlins can occur without damage to the panels or roof purlins. This structure includes deformable centering sleeves adjacent the tab which will deform as necessary to permit such tab movement.

Another further object of the present invention is to provide a deformable centering sleeve with two sides having cutouts provided therein of various configurations, i.e., semi-elliptical, V-shaped, rectangular, square, and the like, and with these cutouts being provided with either equal depth, or with one cutout on each side being of greater depth than the other one on that side, and to facilitate a snap-off action of the sleeve from the cross-piece when actually deformed under pressure thereon.

A further object of the present invention is the provision of angled entrance flanges for facilitating the snapping of the deformable centering sleeve upon a tab supporting cross-piece. These flanges may be of thickness corresponding to the sides of the sleeve, or may be of enlarged and increased cross-sectional size for facilitating mounting on a cross-piece.

Another still further object of the present invention is to provide deformable centering sleeves having cutouts therein for increasing the effective deformation, and further including recessed relief portions provided on each of the respective sides of each sleeve for further increasing the ability to deform.

A still further object of the present invention is to provide a deformable centering sleeve having cutouts therein together with the respective sides between the recesses being grooved, and with the end surfaces of the sleeve being tapered at an angle of approximately 5° from the vertical so that the lower portion of the sleeve will begin to deform prior to the overall deformation thereof, for effectively increasing the entire deforming action of the sleeve.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
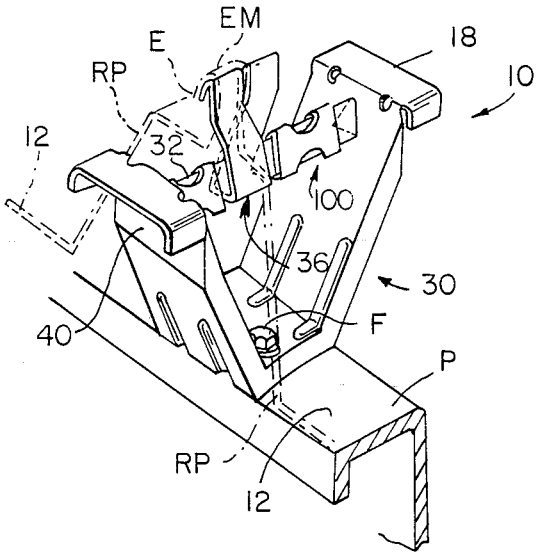
FIG. 1 is a perspective view of a roof panel mounting yoke clip structure with a pair of deformable centering sleeves for holding a roof attaching tab in centered position with the clip.

Shown in FIG. 1 is a clip unit 10 for coupling a pair of roof panels RP to a building structural element such as purlin P, or the like. The roof panels are coupled together at the edges E and EM thereof by crimping those edges together to form standing seams. The panels are preferably those panels manufactured by Butler Manufacturing company under the trademark MR-24 and the trademark CMR-24, and include a central portion 12 and edge portions E and EM.

For further description of the indicated clip unit 10 for mounting roof panels RP to a building purlin P, reference is made to prior application Ser. No. 556,194 assigned to the same assignee as the present invention. The disclosure set forth in this prior application is incorporated herein by specific reference thereto.

The panels RP attach to the purlins P by use of the clip and tab arrangement disclosed herein. Each clip has a tab 36 that is free to move relative to the base. The clip unit base attaches to the purlin and the tab locks into the standing seam at the panel lap so that there is no penetration of the roof panels. This arrangement enables the roof to "float" on the structurals, compensating for expansion and contraction regardless of the severity of temperature changes.

The clip unit 10 includes a yoke-shaped base 30 having a cross-piece 32 attached thereto to span the base. A tab 36 is attached to the cross-piece and extends upwardly therefrom. Aprons 40 extend outwardly from the base and support roof panel shoulder sections 18 thereon as best shown in FIG. 1. A fastener F attaches the base 30 to the purlin P.

Figure 2:
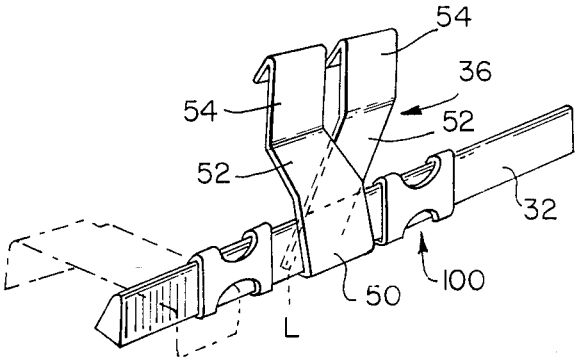
FIG. 2 is a perspective view of a triangular cross-piece for a clip unit, a roof panel attaching tab slidable thereupon, and two deformable centering sleeves, one for each side of the tab for maintaining same centered.

A tab 36 is slidably attached to a cross-piece 32 as shown in FIG. 2, with the center section 50 bent to encircle that cross-piece so that opposite ends of the center section are superposed with each other. The offset nature of the first sections 52 causes those sections to cross over each other and to be outwardly diverging with respect to the center section. A spot weld SW holds sections 52 together as shown. The offset nature of the tongue sections 54 causes those sections to be essentially parallel with each other but spaced from each other and to extend upwardly from the cross-piece. Oil, grease, or Teflon particles to provide lubrication L can be placed between the tab and the cross-piece (i.e., either on the tab, the cross-piece, or both) to increase the ease of slidability of the tab on the cross-piece, if so desired. However, normally such lubrication is not needed.

An end portion of each tongue 54 is formed into a hook. As best shown in FIG. 1, the tab end portions are interleaved with the mated roof panel edges. By being thus interleaved, the tabs will be rolled into the roof panel edge joining seam to thereby movably lock the panel to the purlins via the clip 10. Both ends of the tab are attached to the pair of roof panels, thereby insuring great stability to the connection between the panels and the clip unit.

Tab centering structure 100 (FIGS. 1, 2 and 6) includes a pair of sleeves comprising snap-on centering devices mounted on the cross-piece 32 on either side of the tab 36 to maintain the tab in the desired position on the cross-piece. The sleeve members each have an end in abutting relationship with the tab when in place on the cross-piece to hold the tab centered.

The pair of sleeves 100 are deformable and merely maintain the tab in the desired position, preferably centered, on the cross-piece during the initial installation, i.e., panel handling, mounting and seaming operations. Being deformable, the sleeves do not interfere with desired roof panel movement caused by thermal expansion and contraction after the roof is attached to the building structural elements. The pair of sleeves merely maintain the proper tab position on the clip unit during the initial panel mounting and installation operations. Of course, in addition to having the qualities of being deformable, in certain embodiments the sleeves can also be frangible and/or self-destructible if a high degree of longitudinal pressure is exerted thereupon. That is, upon a slight degree of movement of the roof panels attached to the tab, the adjacent sleeve will deform, but upon a substantially increased movement, the sleeve may disintegrate.

Figure 3A:
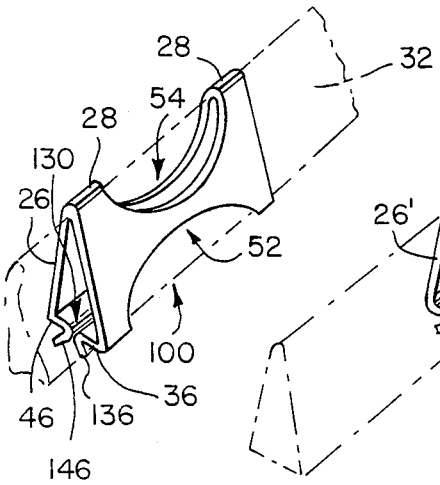
FIG. 3A is a perspective view of an embodiment of a deformable centering sleeve per se, with a slight modification of the semi-elliptical cutouts thereof shown in FIGS. 3B and 3C.

FIG. 3A shows in enlarged detail an embodiment of the deformable centering structure comprising a snap-on sleeve device 100. A triangular cross-piece 32 has mounted thereon the deformable centering sleeve device 100. A side 16 is secured to another side 26 by a connecting hinge 28. Inwardly turned flanges 36 and 46 extend from the lower edges of sides 16 and 26, respectively, and have outwardly diverging edges 136 and 146. Between the diverging edges 136 and 146 a slight gap 130 will exist. Thus, after the tab 36 has been mounted on the clip unit triangular cross-piece 32, a centering sleeve member 100 can be positioned on each side thereof. Preferably, the sleeve members 100 are made of plastic material (e.g., polystyrene, or high impact styrene) which is resilient and semi-flexible to permit the sides 16 and 26 to move outwardly along the connecting hinge 28 and then snap into place on the cross-piece, being, however, constructed so as to be deformable so that the tab holding the appropriate roof panels can move longitudinally of the cross-piece under thermal stresses after the initial installation. Of course, if the material used is high impact styrene, then the sleeves will have an increased ability to fracture and disintegrate under substantial longitudinal pressure thereon.

While plastic, as indicated above, is the preferred material for the deformable centering sleeves, the inventors also recognize that other materials can be used. For example, the sleeves can be made out of light metal such as aluminum, tin or the like, or even spring wire in the manner of a paper clip, which will act the same way and deform and/or pop off the structural support upon which they are placed. Even paper or cardboard construction can be used where minimum cost per unit is desired.

Figure 3B:
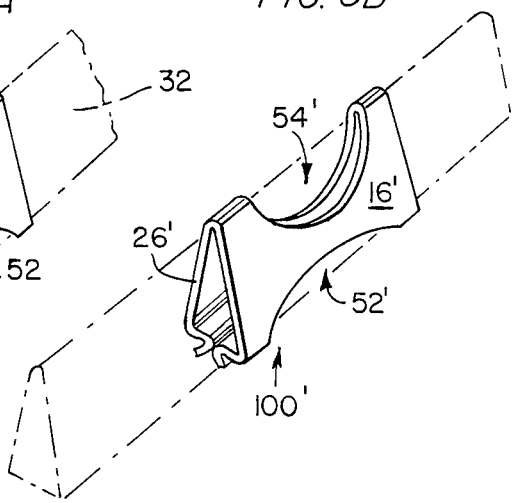
Figure 3C:
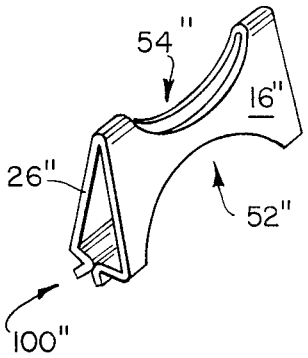

In order to increase the deformability of sleeve member 100, portions are removed from at least one side edge of each side, and preferably from each of the longitudinal side edges of each side. As shown in FIG. 3A, these portions comprise cutouts 52 and 54 in each of the sides. In this embodiment the cutouts are of semi-elliptical shape. In the embodiment of FIG. 3A, the cutouts are of equal size and/or depth. In the slight modification of the invention as shown in FIG. 3B, the cutouts 52' and 54' are shallow and deep, respectively. In the species of FIG. 3C, the cutouts 52" are relatively deep, while the cutouts 54" are relatively shallow. The shape and depth of the cutouts will depend upon the desired function of the sleeve member under the stress of deformation. This will be explained in more detail below.

Figure 4A:
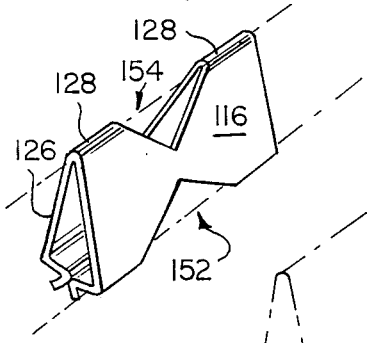
FIG. 4A is another embodiment depicting V-shaped cutouts in the deformable sleeve, with slight modifications thereof shown in FIGS. 4B and 4C.
Figure 4B:
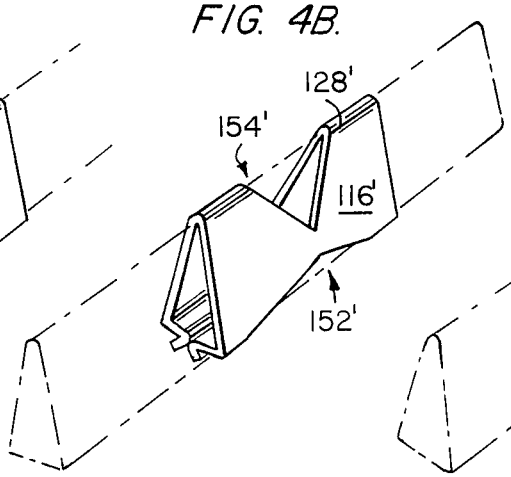
Figure 4C:
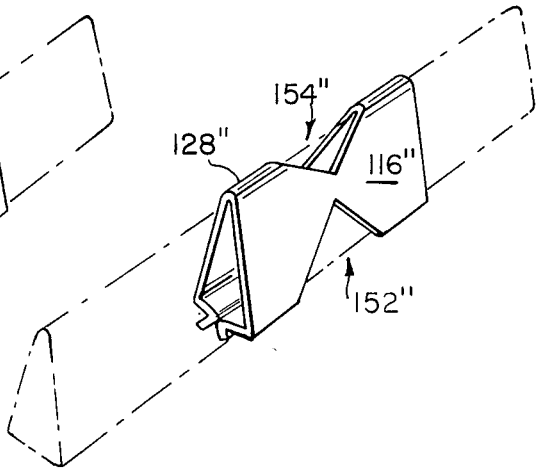

In the embodiment of FIG. 4A, a pair of sides 116 and 126 are connected by hinge structure 128. The other edge of each side is provided with structure for facilitating snapping on of the sleeve member in the same manner as described for FIGS. 3A–3C. The difference of this embodiment from that already described is that the cutouts 152 and 154 are of V-shaped configuration, rather than being semi-elliptical. Again, FIG. 4A shows cutouts of equal depth, FIG. 4B shows cutouts wherein cutout 152' is shallow and cutouts 154' are relatively deep, and FIG. 4C shows the other arrangement, i.e., cutout 152" is relatively deep, while cutouts 154" are relatively shallow.

Figure 5B:
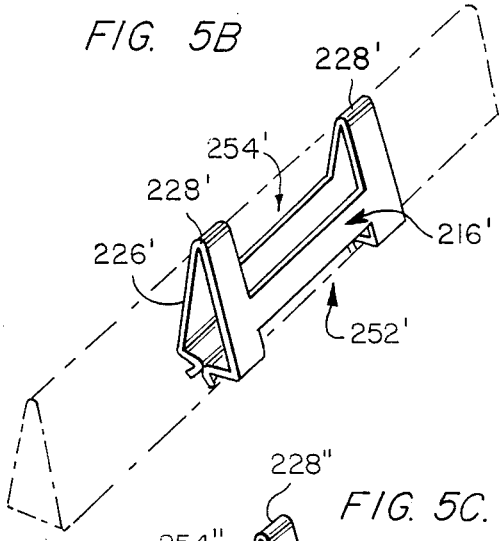
FIG. 5A is a further embodiment depicting rectangular/square cutouts in the deformable sleeve, with slight modifications thereof shown in FIGS. 5B and 5C.
Figure 5A:
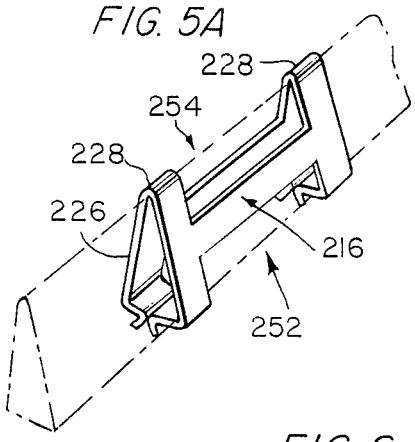
Figure 5C:
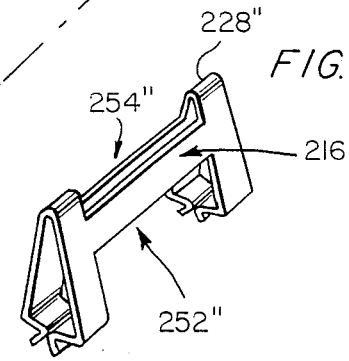

FIGS. 5A–5C show another modification of the FIGS. 3A–3C embodiment. In this arrangement, the cutouts 252 and 254 are of rectangular or square configuration. The rest of the structure is similar to that already described, in that in FIGS. 5B and 5C the cutouts are relatively shallow and/or deep in the same manner as previously described.

Figure 6:
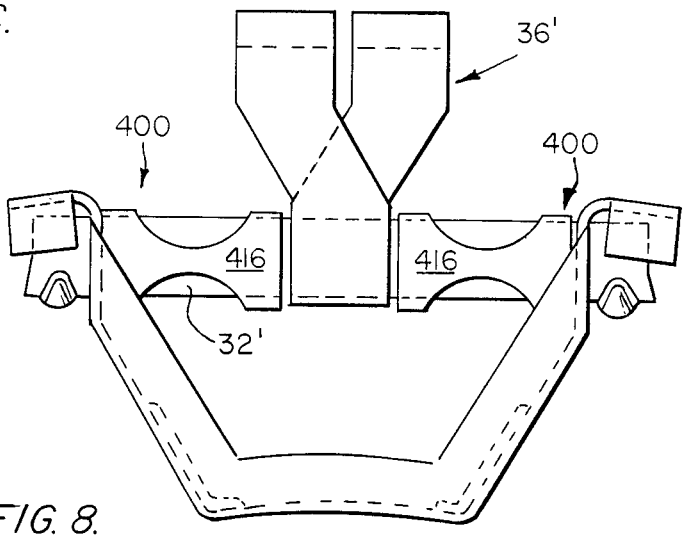
FIG. 6 is a side elevational view of a roof panel mounting yoke clip structure with the deformable centering sleeves of the FIG. 3A embodiment mounted on the cross-piece for holding a roof attaching tab in centered position thereon.

FIG. 6 shows a building roof panel attaching clip unit of shorter configuration than that depicted in FIG. 1. Except for the shorter height, the rest of the structure corresponds to that already described. However, in this figure the preferred embodiment of the sleeve member 400 is shown.

Figure 7B:
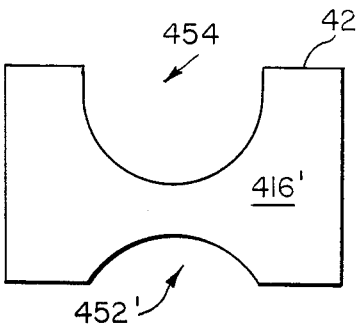
FIG. 7A is a side elevational view of the sleeve of the FIG. 3A embodiment per se, with a slight modification of the semi-elliptical cutouts thereof shown in FIGS. 7B and 7C.
Figure 8:
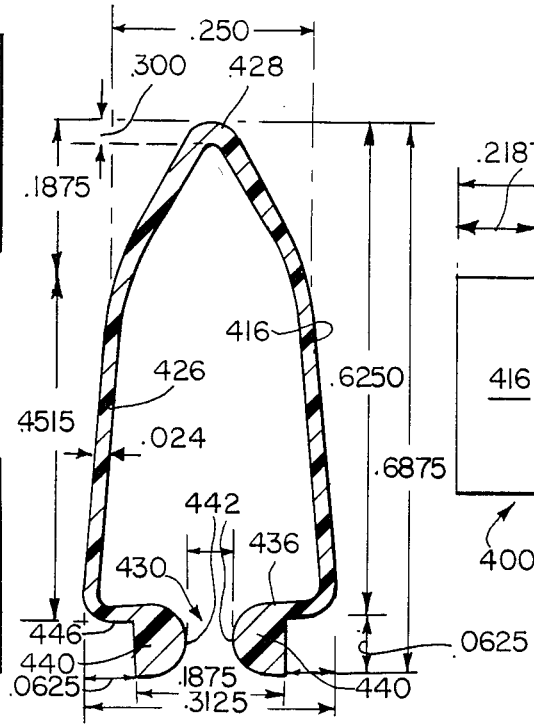
FIG. 8 is an end view of the sleeve of FIGS. 7(A, B, C).
Figure 7A:
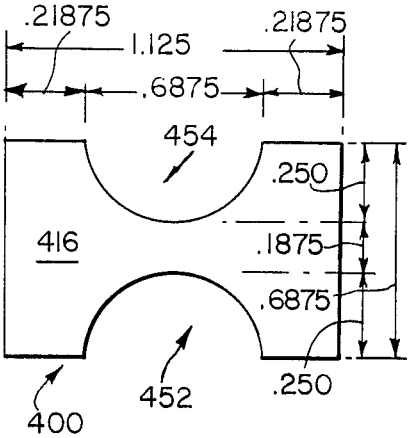

FIGS. 7A and 8 show, respectively, side elevational and end views of this preferred embodiment of the sleeve member.

A pair of elongated sides 416 and 426 are connected together by hinge structure 428 along one side edge of each. The other edge of each side is provided, respectively, with inwardly extending flanges 436 and 446, which each terminate in a thickened portion 440. This thickened portion 440 preferably has a rounded inner edge 442 for performing the desired camming/wedging action to open the sleeve when it is being mounted upon (snapped on) a cross-piece 32'.

Figure 7C:
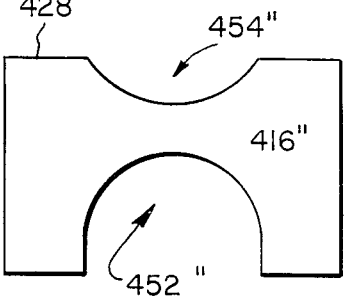
Figure 9:
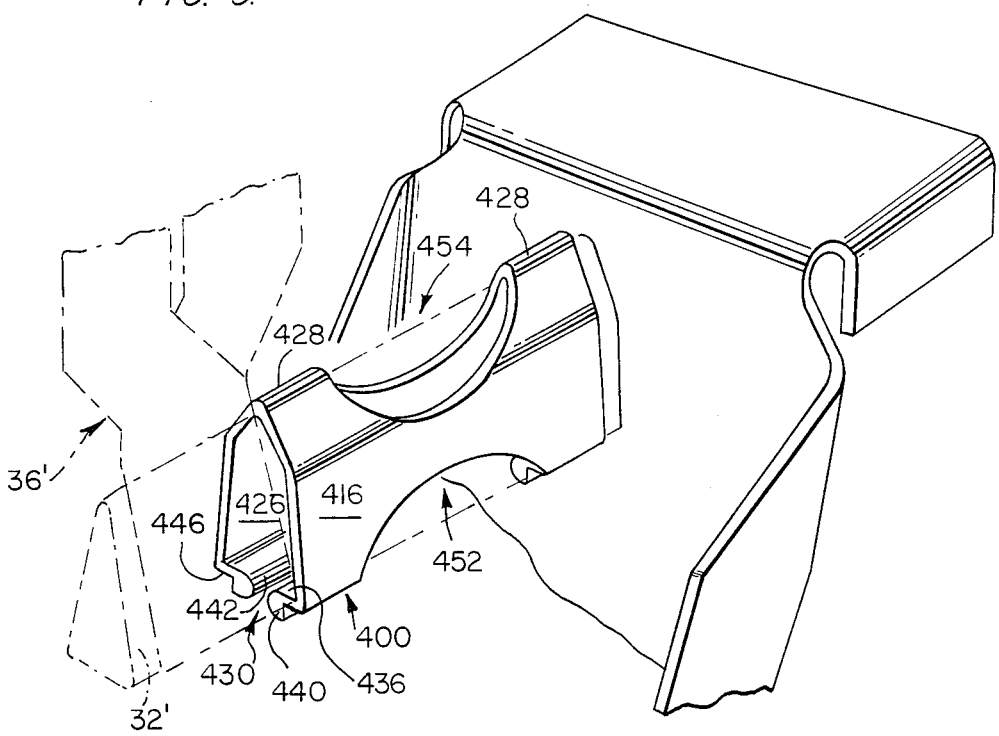
FIG. 9 is a perspective view depicting the sleeve of the FIG. 3A embodiment as snapped over a clip cross-piece.
Figure 10:
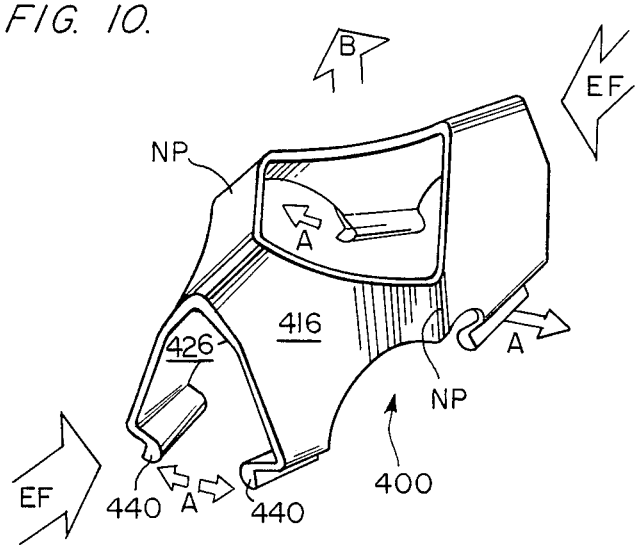
FIG. 10 is a perspective view showing the sleeve per se and the catapulting action effected by compression exerted thereon.

FIGS. 9 and 10 show the catapulting action type ejection of the embodiment of the sleeve shown in FIGS. 6–8. As best seen in FIG. 9, the sleeve 400 is mounted upon a clip unit cross-piece 32' for maintaining a tab 36' centered thereon. The sleeve 400 has been mounted by a snap-on action through the rounded faces 442 of the reinforced beads 440. A gap 430 is normally present between the two opposite faces 442 which when pressed downwardly on the center top edge of the cross-piece 32', effects movement outwardly of the sleeve member sides 416 and 426. Once the lower flanges 436 and 446 clear the bottom of the triangular cross-piece, the sleeve sides 416 and 426 will snap towards each other because of the resilient function of hinge structure 428. This is because of the combination of the formed sleeve being made of resilient yet flexible material and also the structural arrangement and dimensions of the device. In this embodiment, cutouts 452 and 454 are also provided to increase the deformability of the sleeve member per se. All of the species already depicted, i.e., semi-elliptical cutouts of equal, or relatively shallow and deep depths, as well as the V-shaped, rectangular shaped and/or square shaped cutouts of the previous embodiments are encompassed in this embodiment.

FIG. 10 shows how the sleeve 400 is disengaged from the cross-piece under longitudinal compression thereof. The longitudinal compression is indicated by horizontal arrows EF being applied to each of the end edges of the sleeve. This will effect a bending of the narrow portions NP of the sides between the respective cutouts which will in turn cause outward movement of the sides and lower thickened portions as indicated by arrows A. As a result a catapulting and disengaging action is effected which will cause the sleeve 400 to move as indicated by arrow B. Thus, the sleeve 400 will be completely ejected from engagement with cross-piece 32'. In some cases, the sleeve will tear apart along the hinge structure 428 and thus separate into two parts in the manner depicted in FIGS. 12 and 13.

The inventors have also discovered that if the sleeves are made of plastic material, it is further possible to control and improve the deformability and/or self-destruct characteristics thereof by reducing the thickness of the respective narrow portions NP of the sides. This can be done by grooving or notching the narrow portions NP near the center thereof to provide a reduced area where it is desirable for the folding action of the side to occur. This modification of the FIGS. 3–10 embodiments is depicted in FIGS. 11–17.

The overall design is very small and compact and yet extremely strong. The deformable and self-destructable centering structure, including all of the various embodiments disclosed, will aid in initial installation of the tab, clip and yoke by maintaining the tab in approximately the center position of the yoke. However, once the initial installation has been completed, then the self-centering structures can be deformed, and/or removed to permit the required and necessary thermal expansion of the roof panels so that they will not buckle or rip apart the double seam attachment.

The preferred embodiment of the present invention is depicted in FIGS. 11–17. In this embodiment the sleeve is of similar construction and arrangement to that depicted in FIGS. 9 and 10. Corresponding elements are referred to by the same reference numerals with a prime added thereto. However, the narrow portions NP of each side are reduced approximately midway thereof by grooves or relief areas 448. In the FIG. 11 embodiment, the recess 448 is in the form of a semi-circular groove, and the ends 516 taper inwardly.

Figure 12:
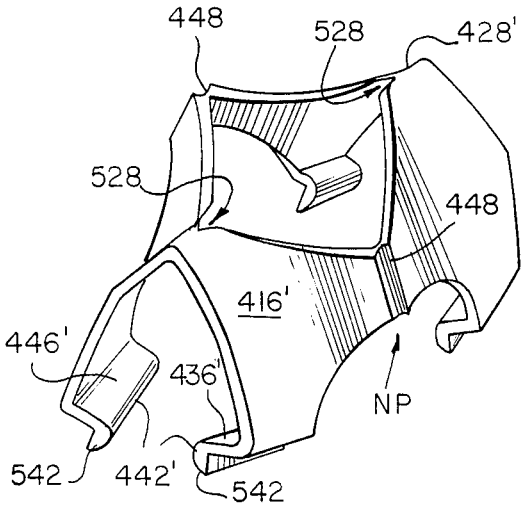
FIG. 12 is a perspective view showing the sleeve of the FIG. 11 preferred embodiment after being placed under slight longitudinal pressure.

FIG. 12 shows how the sides bend at the groove portions 448 under slight longitudinal pressure on the respective ends 516 of the sleeve. This effects the beginning of tearing 528 of the hinge structure 428'. When additional pressure is exerted on the ends of the sleeve, the outward motion of the narrow portions NP continues until finally the hinges rip apart as indicated by the double arrows AA. Of course, the respective sides of the sleeve then move away from the cross-bar (not shown) in the direction of arrows BB.

Figure 11:
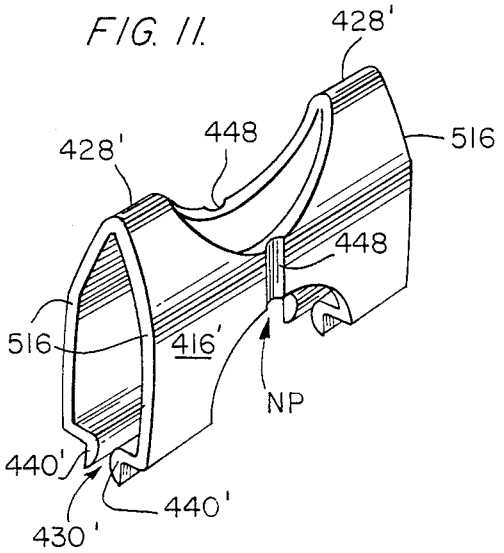
FIG. 11 is a perspective view of another modification for increasing the deformability of the sleeve, which embodiment is the preferred one.
Figure 13:
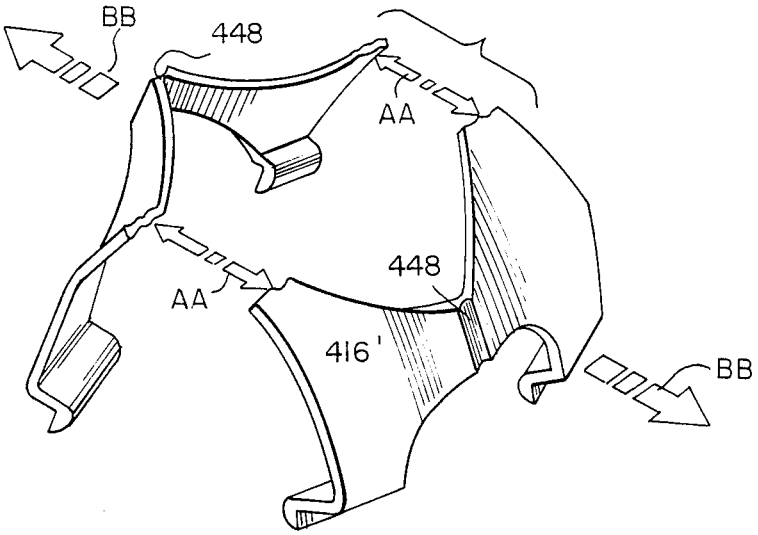
FIG. 13 is the sleeve of the embodiment of FIGS. 11 and 12 depicting the resulting effect after the longitudinal pressure has been increased to a point of maximum deformation and/or disintegration thereof.
Figure 14:
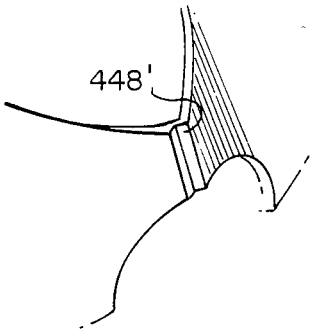
FIG. 14 depicts a slight modification of the sleeve embodiment of FIGS. 11–13.

The FIG. 14 modification uses a V-shaped relief area 448' instead of the semi-circular area depicted in FIGS. 11–13. Of course, other type of relief areas are envisioned by the inventors, and actually can comprise a mere thinning of the narrow portions NP rather than any specific groove or recess therethrough.

Figure 15:
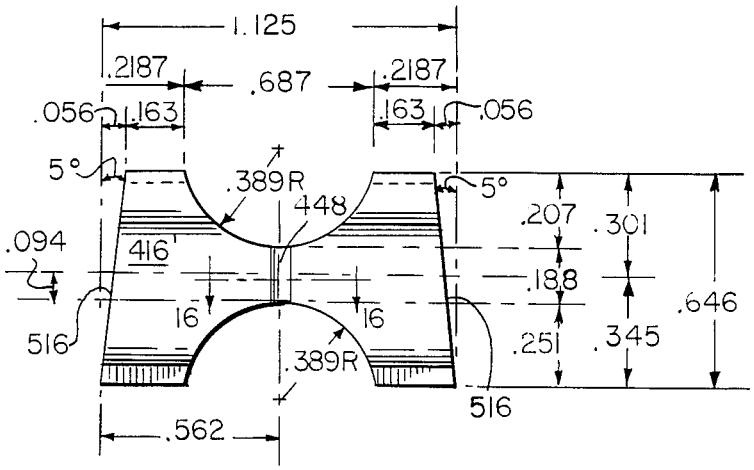
FIG. 15 is a side elevational view of the preferred embodiment of FIG. 11 showing the tapered end surfaces of the sleeve.
Figure 16:
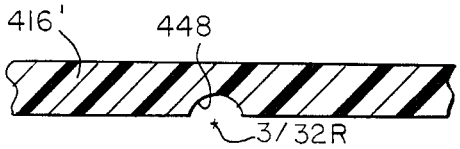
FIG. 16 is a fragmentary portion showing the half-moon shape (semi-circular) of one side recess or groove.
Figure 17:
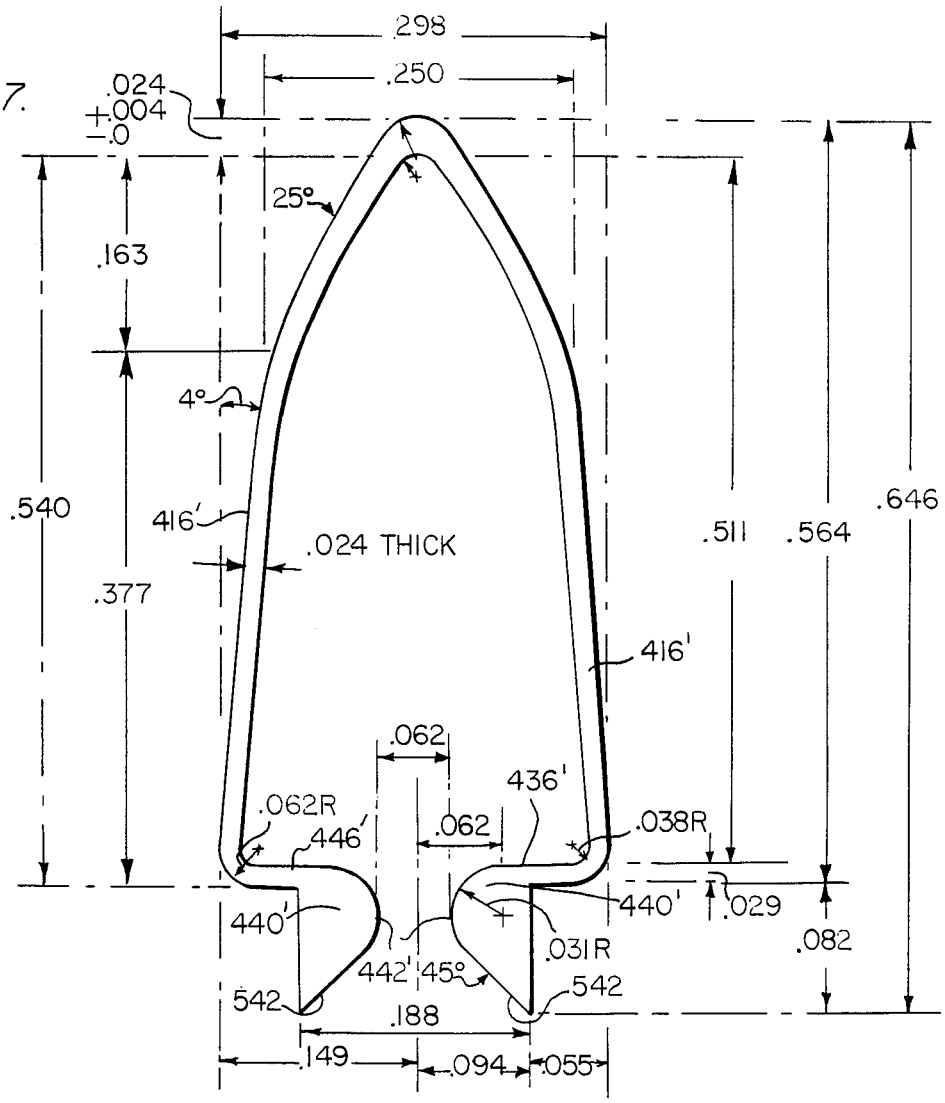
FIG. 17 is an end view of the sleeve of FIG. 15 showing suitable dimensions thereof.

FIGS. 15–17 show in specific detail the preferred embodiment and dimensions thereof which have been found to be very suitable in actual use. Also, as can be clearly seen in FIG. 15, the ends 516 of the sleeve have a pronounced inward and upward taper of approximately 5° from the vertical. It has been discovered that by slightly tapering the respective ends of the sleeve, by just a small amount such as 5°, the force caused by the movement of the roof tab due to thermal expansion of the roof panels attached thereto is exerted on the bottom portion of the sleeve ends first. By concentrating the load initially at this point, the sleeve will deform under an even lesser load than the sleeves of the previous embodiments. Another important feature, perhaps just as important as the achievement of a lesser load requirement, is the fact that the load being concentrated at the lower ends thereof causes the sleeve to collapse and/or open up much more easily. This has been discovered to be a very important new and novel result of the preferred embodiment of the invention. While 5° has been found to be most desirable, a slight variation of same also is encompassed by this invention.

Another feature of the preferred embodiment is that the lead-in surfaces 542 adjacent the rounded faces 442' are tapered downwardly to increase the effective lead-in feature of this embodiment. Thus, installation and snap-on engagement of the sleeve on a cross-piece is considerably facilitated. The 45° angle of the lead-in portion 542 as shown in FIG. 17 has been found to be very workable.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A structural device for attaching roof panels to a support element of a building comprising:

a support yoke;

a cross-piece supported by said support yoke;

an attaching tab for engagement with a pair of complementary roof panels as supported by said support yoke, said attaching tab encircling and being slidably mounted on said cross-piece; and longitudinally deformable centering means mounted on each side of said attaching tab as mounted on said cross-piece for retaining said tab centered with respect to the support yoke during initial roof panel installation and yet permitting movement of said tab thereafter during thermal expansion/contraction of said roof panels.

2. The structural device defined in claim 1, wherein said longitudinally deformable centering means comprises a sleeve member having two sides connected by a hinge portion along one edge of each side, the other edge of each side having means for facilitating the snapping of the sleeve member onto said cross-piece.

3. The structural device defined in claim 2, wherein said clip member is made of material means which is resilient and yet deformable.

4. The structural device defined in claim 3, wherein said material means is a plastic material.

5. The structural device defined in claim 4, wherein said plastic material is polystyrene.

6. The structural device defined in claim 2, wherein said means for facilitating the snapping of the sleeve member onto said cross-piece includes extending flanges along the edge of each side of said sleeve opposite of the hinge portion thereof.

7. The structural device defined in claim 6, wherein each extending flange is of approximately the same thickness as that of each side thickness, and is configured to provide an opening wedging action when said sleeve is pressed onto a clip cross-piece.

8. The structural device defined in claim 6, wherein each extending flange is of greater thickness than that of each side thickness and forms a reinforced bead portion, and is configured to provide an opening wedging action when said sleeve is pressed onto a clip cross-piece.

9. The structural device defined in claim 2, wherein at least one edge of each side of said sleeve member has a portion removed therefrom so that the sides can be easily deformed under longitudinal compression thereof.

10. The structural device defined in claim 9, wherein said removed portion is in the form of a cutout in each of said sides, each cutout being in the shape of a semi-ellipse.

11. The structural device defined in claim 10, wherein both edges of each side of said sleeve member have a removed portion thereby providing a cutout of semi-elliptical shape in both edges of each side.

12. The structural device defined in claim 11, wherein one semi-elliptical cutout is shallow, and the other semi-elliptical cutout is relatively deep.

13. The structural device defined in claim 9, wherein said removed portion is in the form of a cutout in each of said sides, each cutout being V-shaped.

14. The structural device defined in claim 13, wherein both edges of each side of said sleeve member have a removed portion thereby providing a cutout of V-shape in both edges of each side.

15. The structural device defined in claim 14, wherein one V-shaped cutout is shallow, and the other V-shaped cutout is relatively deep.

16. The structural device defined in claim 9, wherein said removed portion is in the form of a cutout in each of said sides, each cutout being in the shape of a rectangle/square.

17. The structural device defined in claim 16, wherein both edges of each side of said sleeve member have a removed portion thereby providing a cutout of rectangular/square shape in both edges of each side.

18. The structural device defined in claim 17, wherein one rectangular/square cutout is shallow, and the other rectangular/square cutout is relatively deep.

19. A longitudinally deformable centering sleeve for use with a building structure cross-piece comprising:

an elongated body having two sides substantially parallel to each other, said sides being connected along one edge of each thereof by resilient hinge structure, cutout means provided with each side for increasing the ability of said sleeve to be deformed longitudinally, and means provided along the opposite edge of each side from said hinge structure to facilitate the mounting of said sleeve upon said building structure cross-piece.

20. The sleeve defined in claim 19, wherein said means for facilitating the mounting of said sleeve member upon the building structure cross-piece includes configured flanges shaped with a reverse bend for providing a wedging action to said sleeve sides when the sleeve is being mounted upon said cross-piece.

21. The sleeve defined in claim 20, wherein said configured flanges are of the same thickness as the elongated sides of said sleeve.

22. The sleeve defined in claim 20, wherein said configured flanges are of a greater thickness than said side edges, and comprise a thickened portion along the opening of said side edges.

23. The sleeve defined in claim 19, wherein said elongated body is made of material means which is deformable.

24. The sleeve defined in claim 23, wherein said material means is a plastic material.

25. The sleeve defined in claim 24, wherein said plastic material is polystyrene.

26. The sleeve defined in claim 34, wherein said plastic material is high impact styrene.

27. The sleeve defined in claim 19, wherein said cutout means are provided by recesses inwardly from each edge of each side member so as to provide a pair of cutouts for each sleeve side.

28. The sleeve defined in claim 27, wherein said side edge cutouts are in a predetermined shape, such shape being selected from the group consisting of semi-elliptical, V-shaped, rectangular shaped and square shaped.

29. The sleeve defined in claim 27, wherein said elongated body is made of material means which is deformable.

30. The sleeve defined in claim 29, wherein said material means is a plastic material.

31. The sleeve defined in claim 30, wherein said plastic material is polystyrene.

32. The sleeve defined in claim 30, wherein said plastic material is high impact styrene.

33. A longitudinally deformable centering device for use with a building structure support piece comprising:

an elongated body having two sides, said sides being connected along one edge of each thereof by resilient hinge structure, cutout means provided with each side for increasing the ability of said body to be deformed longitudinally, and further means provided along each side to facilitate the disengagement of said body from said building structure support piece.

34. The centering device defined in claim 33, wherein said further means for facilitating the disengagement of said body from the building structure support piece includes an area of reduced thickness in the mid-portion of each side for providing a folding action to said body sides when the sleeve is being subjected to pressure on the respective ends thereof.

35. The centering device defined in claim 34, wherein said cutout means provided with each side comprises recesses inwardly from each edge of each body side so as to provide a pair of cutouts for each side.

36. The centering device defined in claim 35, wherein said side edge cutouts are in a predetermined shape, such shape being selected from the group consisting of semi-elliptical, V-shaped, rectangular shaped and square shaped.

37. The centering device defined in claim 36, wherein one side edge cutout is shallow, and the other side edge cutout is relatively deep.

38. The centering device defined in claim 37, wherein said elongated body is made of material means which is readily deformable.

39. The centering device defined in claim 38, wherein said material means is a high impact plastic material.

40. A longitudinally deformable centering device for use with a building structure support piece comprising:

an elongated body having two sides, said sides being connected along one edge of each thereof by resilient hinge means, further means provided with each side for increasing the ability of said body to be deformed longitudinally, additional means provided along the opposite edge of each side from said hinge structure to facilitate the mounting of said sleeve upon said building structure support piece, and still other means for decreasing the force needed on the sleeve to deform it.

41. The centering device defined in claim 40, wherein said additional means to facilitate sleeve mounting on a support piece includes cam surfaces formed along the opposite edge of each side from said hinge means.

42. The centering device defined in claim 41, wherein said cam surfaces comprise a curved face portion and a tapered lead-in surface thereto.

43. The centering device defined in claim 40, wherein said other means for decreasing the sleeve deformation force includes at least one end of said sleeve having a taper thereto.

44. The centering device defined in claim 43, wherein said taper is at both ends of the sleeve, and is approximately 5° from the vertical.

45. The centering device defined in claim 40, wherein said further means for increasing the ability of said body to be deformed includes areas of the mid-portion of each side which offer substantially less resistance to deformation than the rest of the side areas.

46. The centering device defined in claim 45, wherein said areas of substantially less resistance include a recess provided across the mid-portion of each side.

47. The centering device defined in claim 46, wherein said other means for decreasing the sleeve deformation force includes at least one end of said sleeve having a taper thereto.

48. The centering device defined in claim 47, wherein said taper is at both ends of the sleeve, and is approximately 5° from the vertical.

49. The centering device defined in claim 47, wherein said additional means to facilitate sleeve mounting on a support piece includes cam surfaces formed along the opposite edge of each side from said hinge means.

50. The centering device defined in claim 49, wherein said cam surfaces comprise a curved face portion and a tapered lead-in surface thereto.

51. A longitudinally centering device for use with a building structure support piece comprising:

an elongated body having two sides, said sides being connected along one edge of each thereof by resilient hinge structure, cutout means provided with each side for increasing the ability of said body to be deformed longitudinally, further means provided along each side to facilitate the disengagement of said body from said building structure support piece, and additional means for decreasing the force needed on the sleeve to deform same.

52. The centering device defined in claim 57, wherein the taper of the sleeve ends is approximately five degrees (5°) from the vertical.

53. The centering device defined in claim 51, wherein said additional means for decreasing the force needed to deform the sleeve includes each of the ends of the sleeve being tapered outwardly and downwardly from the hinge structure.

54. The centering device defined in claim 53, wherein the taper of the sleeve ends is approximately five degrees (5°) from the vertical.

55. The centering device defined in claim 51, wherein said further means for facilitating the disengagement of said body from the building structure support piece includes an area of reduced thickness in the mid-portion of each side for providing a folding action to said body sides when the sleeve is being subjected to pressure on the respective ends thereof.

56. The centering device defined in claim 55, wherein said cutout means provided with each side comprises cutouts inwardly from each edge of each body side so as to provide a pair of cutouts for each side.

57. The centering device defined in claim 56, wherein said additional means for decreasing the force needed to deform the sleeve includes each of the ends of the sleeve being tapered outwardly and downwardly from the hinge structure.

* * * * *